US010753323B2

(12) United States Patent
Yamada et al.

(10) Patent No.: US 10,753,323 B2
(45) **Date of Patent: *Aug. 25, 2020**

(54) ENGINE INTAKE AND EXHAUST SYSTEM

(71) Applicant: Mazda Motor Corporation, Aki-gun, Hiroshima (JP)

(72) Inventors: Hisayoshi Yamada, Hiroshima (JP); Yuji Kojima, Hiroshima (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/218,828

(22) Filed: Dec. 13, 2018

(65) Prior Publication Data

US 2019/0234355 A1 Aug. 1, 2019

(30) Foreign Application Priority Data

Jan. 26, 2018 (JP) ..... 2018-011761

(51) Int. Cl.

| | |
|---|---|
| ***F02B 47/08*** | (2006.01) |
| ***F02M 35/10*** | (2006.01) |
| ***F02M 26/21*** | (2016.01) |
| ***F02M 26/23*** | (2016.01) |
| ***F02M 26/28*** | (2016.01) |
| ***F02M 26/35*** | (2016.01) |
| ***F02M 26/14*** | (2016.01) |
| ***F02M 26/06*** | (2016.01) |

(52) U.S. Cl.

CPC ..... *F02M 35/10222* (2013.01); *F02M 26/06* (2016.02); *F02M 26/14* (2016.02); *F02M 26/21* (2016.02); *F02M 26/23* (2016.02); *F02M 26/28* (2016.02); *F02M 26/35* (2016.02); *F02M 35/10157* (2013.01)

(58) Field of Classification Search

CPC ..... F02M 26/00; F02M 26/05; F02M 26/27; F02M 26/28; F02M 26/29; F02M 26/32

USPC ..... 123/568.11, 568.12, 568.21

See application file for complete search history.

(56) References Cited

U.S. PATENT DOCUMENTS

| | | | | |
|---|---|---|---|---|
| 2012/0301364 | A1 | 11/2012 | De Malet et al. | |
| 2015/0240750 | A1 * | 8/2015 | Tsuda | F02C 6/12 60/605.2 |
| 2016/0319716 | A1 * | 11/2016 | Mitsuda | F01N 3/055 |
| 2019/0234350 | A1 * | 8/2019 | Yamada | B60K 13/02 |
| 2019/0234353 | A1 * | 8/2019 | Yamada | F01N 13/08 |

FOREIGN PATENT DOCUMENTS

| | | | |
|---|---|---|---|
| JP | 2015161225 | A | 9/2015 |

* cited by examiner

*Primary Examiner* — John Kwon

(74) *Attorney, Agent, or Firm* — Alleman Hall Creasman & Tuttle LLP

(57) ABSTRACT

An intake and exhaust system of an engine is provided, which includes an exhaust gas recirculation (EGR) passage configured to recirculate a portion of exhaust gas as EGR gas, from an exhaust passage of the engine to an intake passage, and an EGR cooler disposed in the EGR passage, the EGR cooler being coupled to a passage wall of the exhaust passage at an EGR gas inlet side, and having a center line intersecting with a flow direction of exhaust gas in the exhaust passage. A through-hole communicating the EGR cooler with the exhaust passage is formed into a long hole elongated in the flow direction in the exhaust passage.

4 Claims, 9 Drawing Sheets

ENGINE INTAKE AND EXHAUST SYSTEM

TECHNICAL FIELD

The present disclosure relates to an engine intake and exhaust system.

BACKGROUND OF THE DISCLOSURE

JP2015-161225A discloses an intake and exhaust system of an engine in which an exhaust gas recirculation (EGR) passage which leads a portion of exhaust gas as an EGR gas from an exhaust passage located downstream of a DPF (Diesel Particulate Filter) to an intake passage is provided, and an EGR cooler and an EGR valve are provided in the EGR passage.

In the intake and exhaust system, the DPF is arranged on a rear side of an engine body with its axis extending in a lined-up direction of cylinders, and an exhaust pipe extending at the rear of an automobile is connected to a downstream end of the DPF. The EGR cooler is connected to a side surface (an opposite side from the DPF) of the exhaust pipe, and the EGR valve is fixed to a side surface (an opposite side from the DPF) of the EGR cooler. An EGR pipe extends upward from the EGR valve and is connected to a horizontally extending part of an intake pipe located upstream of a compressor of a turbocharger. Further, a blow-by gas pipe which introduces blow-by gas into the intake passage is connected to a position near a connected part of the intake pipe with the EGR pipe.

With this intake and exhaust system, the EGR gas horizontally passes through the EGR cooler from the exhaust pipe, and then is led upward from the EGR valve through the EGR pipe.

In the intake and exhaust system, when condensed water is generated in the EGR passage, the condensed water may stagnate in a horizontal part of the EGR passage, that is, in a part where the EGR cooler and the EGR valve are provided. In this regard, it may be considered to arrange the EGR passage, including the EGR cooler, to extend vertically from the exhaust passage to the intake passage. According to this structure, the condensed water is discharged to the exhaust passage through an EGR passage wall and is prevented from stagnating in an intermediate part of the EGR passage.

However, forming the EGR passage as such reduces a passage resistance when the EGR gas flows from the exhaust passage toward the intake passage. As a result, it becomes easy for the EGR gas to pass through the EGR cooler, which lowers cooling efficiency of the EGR gas by the EGR cooler. That is, it becomes more difficult to cool the EGR gas.

SUMMARY OF THE DISCLOSURE

Therefore, the present disclosure is made in view of the above situations and aims to efficiently cool EGR gas by an EGR cooler.

According to one aspect of the present disclosure, an intake and exhaust system of an engine is provided, which includes an exhaust gas recirculation (EGR) passage configured to recirculate a portion of exhaust gas as EGR gas, from an exhaust passage of the engine to an intake passage, and an EGR cooler disposed in the EGR passage, the EGR cooler being coupled to a passage wall of the exhaust passage at an EGR gas inlet side, and having a center line intersecting with a flow direction of exhaust gas in the exhaust passage. A through-hole communicating the EGR cooler with the exhaust passage is formed into a long hole elongated in the flow direction in the exhaust passage.

According to this structure, the strength (flow amount) of the EGR gas flowing from the exhaust passage into the EGR cooler through the through-hole does not vary much between an upstream end part and a downstream end part of the gas flowing direction at the through-hole since the through-hole is the long hole as described above. That is, the portion of exhaust gas used as EGR gas is flowed into the EGR cooler from the entire area of the elongated through-hole at a relatively uniform strength. As a result, the EGR gas passes the EGR cooler at a relatively uniform flow rate, while spreading in the flow direction of the exhaust gas, and thus, utilization efficiency of the EGR cooler improves, which becomes advantageous for cooling the EGR gas.

In addition, the flow rate of the exhaust gas flowing in the exhaust passage is not uniform over an entire cross section of the passage, and the flow rate tends to be slower in a circumferential portion than at a center portion. Thus, if the through-hole is not the elongated hole as described above, but is for example, a circle (complete circle), the strength of the EGR gas passing through the circle hole differs in the width direction of the exhaust passage. For example, the EGR gas is weaker at both side portions of the circle hole than the center portion thereof. With such a hole, even if an opening area of the hole is the same, the utilization efficiency of the EGR cooler is not improved. In this regard, according to this structure, by having the through-hole elongated in the exhaust gas flowing direction, the exhaust gas flows into the EGR cooler at a relatively uniform strength from the entire area of the through-hole.

An exhaust gas purifier may be provided in an intermediate part of the exhaust passage. The exhaust gas passage may have a curve on a downstream side of the exhaust gas purifier in the flow direction to change the flow direction. The through-hole communicating the EGR cooler with the exhaust passage may open to a passage wall of the curve of the exhaust passage at an outer circumferential side.

In the exhaust passage downstream of the exhaust gas purifier, pressure of the exhaust gas is lower than that on the upstream side. However, the coupled position of the EGR cooler, although also on the downstream side, is in a portion on the outer circumference side of the curve of the exhaust passage. Since the flow of the exhaust gas is slower and the pressure of the exhaust gas is relatively higher on the outer circumferential side of the curve of the exhaust passage than on the inner circumferential side. Thus, regardless of the EGR cooler coupled to the exhaust passage downstream of the exhaust gas purifier, the EGR gas is efficiently introduced into the EGR cooler.

A position of the intake passage to which the EGR passage is connected may be located higher than a position of the exhaust passage to which the EGR passage is connected. The EGR cooler may be coupled at the EGR gas inlet side to an upper surface side of the passage wall of the exhaust passage, and the entire EGR passage may extend upwardly toward the position of the intake passage to which the EGR passage is connected.

Thus, the EGR gas easily flows from the exhaust passage toward the intake passage, which is advantageous in improving the utilization efficiency of the EGR cooler. Moreover, even when the EGR gas is condensed on an inner wall of the EGR passage to generate the condensed water, it is easily discharged to the exhaust passage.

DETAILED DESCRIPTION OF THE DISCLOSURE

Hereinafter, one embodiment of the present disclosure is described with reference to the accompanying drawings. The following description of a preferable embodiment is essentially nothing more than an illustration, and is not to limit the present disclosure, an application thereof, or a usage thereof.

Figure 1:
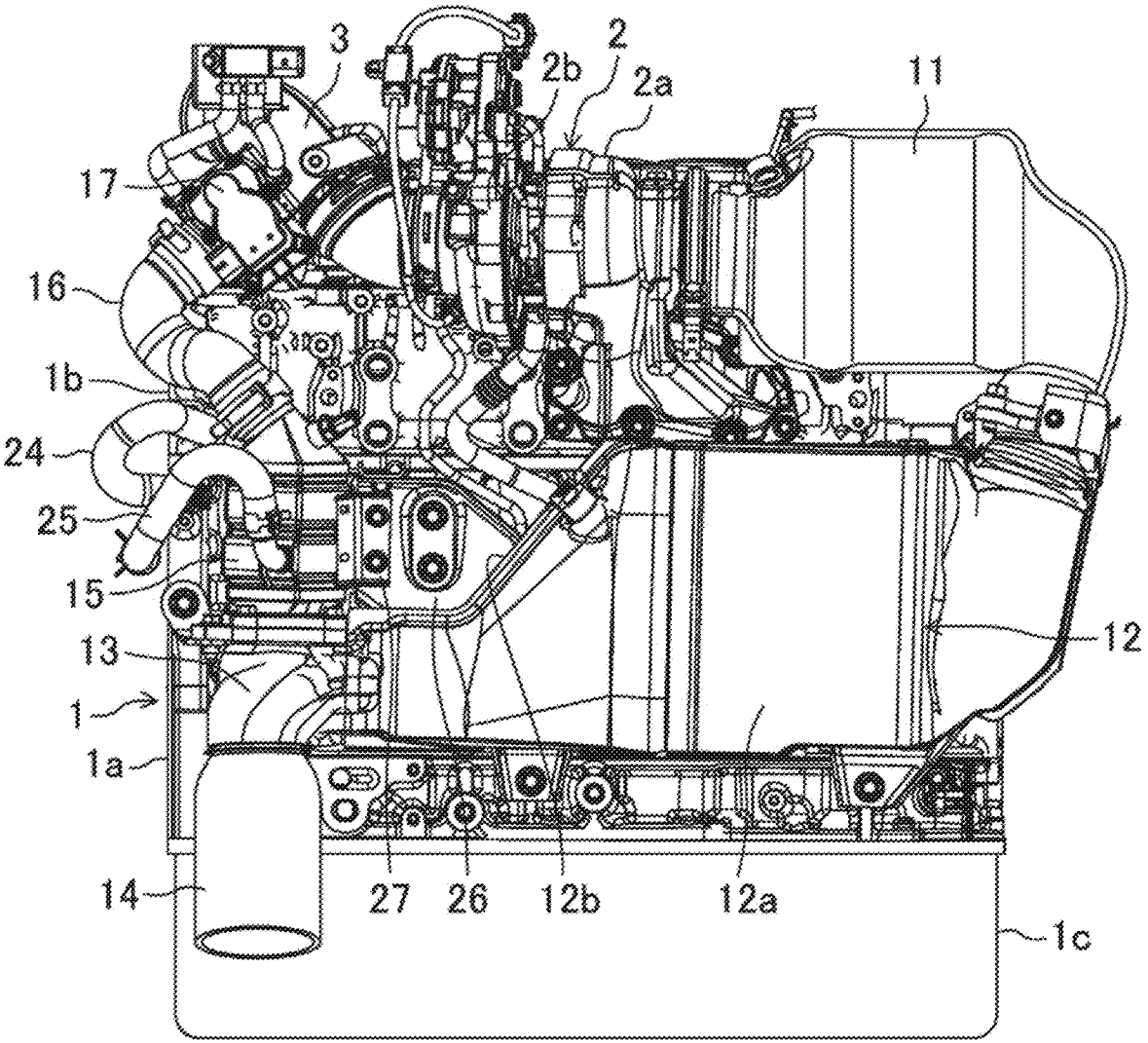
FIG. 1 is a side view of an exhaust side of an engine according to one embodiment of the present disclosure.

In an intake and exhaust system of an engine of an automobile illustrated in FIG. 1, a reference number "1" is an engine body, and includes a cylinder block 1*a*, a cylinder head 1*b* fixed to an upper surface of the cylinder block 1*a*, and an oil pan 1*c* fixed to a lower surface of the cylinder block 1*a*.

<Intake System and Exhaust System of Engine>

An exhaust turbocharger 2 having a center line extending in a lined-up direction of cylinders along a side surface of the engine body 1 is provided on an exhaust side (an exhaust side of the cylinder head 1*b*) of the engine body 1. In the engine of this embodiment, an exhaust manifold is provided inside the cylinder head 1*b*, and a downstream end of a manifold section of the exhaust manifold opens to an exhaust-side surface of the cylinder head 1*b*. An exhaust gas inlet side of a turbine 2*a* of the turbocharger 2 is connected to this opening. An upstream-side intake pipe 3 which introduces fresh air is connected to a compressor 2*b* of the turbocharger 2.

Figure 2:
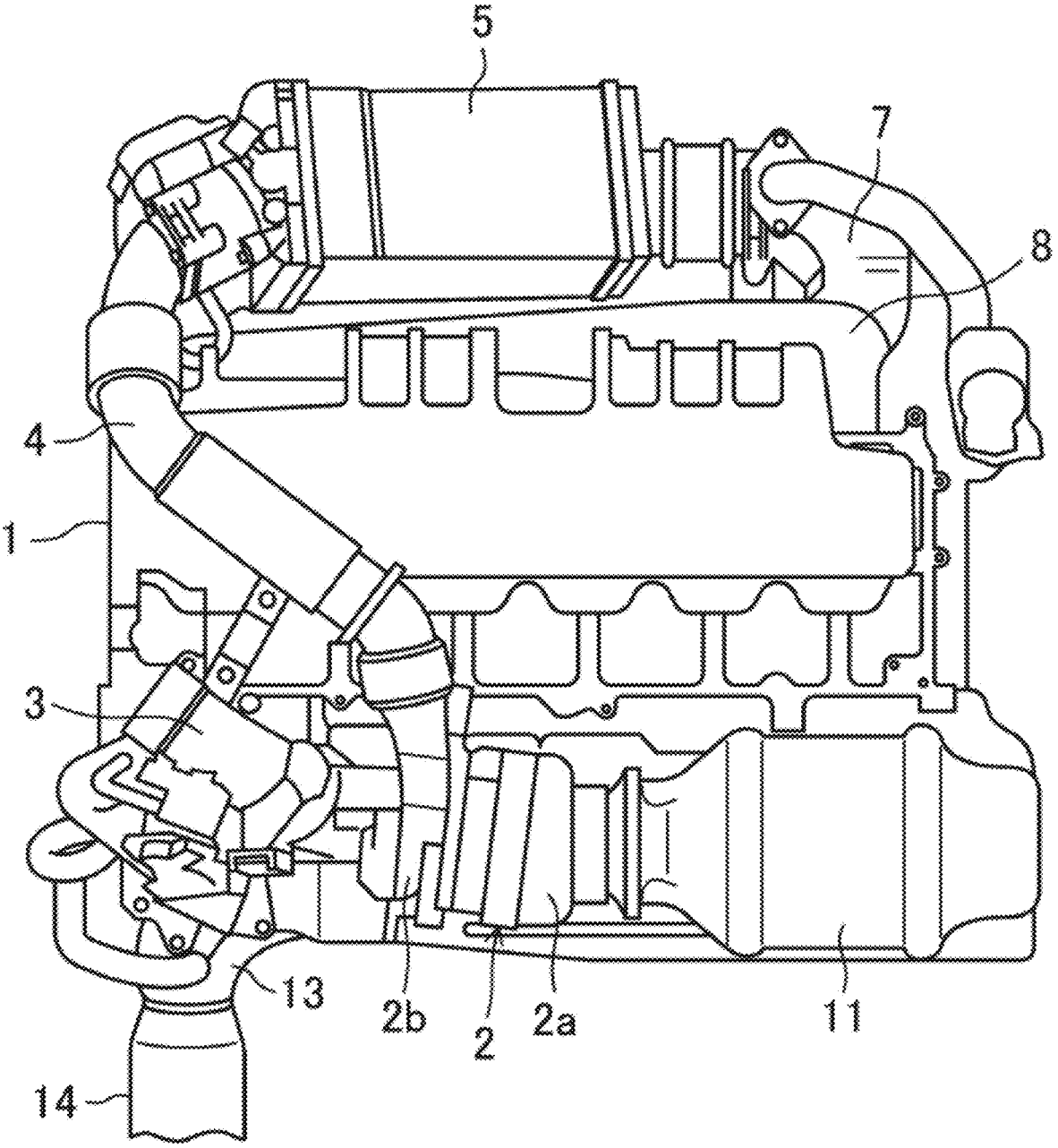
FIG. 2 is a plan view of the engine.

As illustrated in FIG. 2, the compressor 2*b* of the turbocharger 2 is connected to an intermediate intake pipe 4 which leads pressurized fresh air to the intake side of the cylinder head 1*a*. The intermediate intake pipe 4 passes over the cylinder head 1*a*, extends from the exhaust side of the engine body 1 to the intake side, and is connected to an upstream end of an intercooler 5 which is arranged on the intake side and cools the fresh air. The intercooler 5 is provided such that its center line extends in the cylinder lined-up direction along an intake side surface of the engine body 1, and a downstream-side intake pipe 7 is connected to its downstream end. A downstream end of the downstream-side intake pipe 7 is connected to a surge tank 8 of the engine. The surge tank 8 is connected to an intake manifold (not illustrated) of the engine body 1.

Here, the upstream-side intake pipe 3, the compressor 2*b* of the turbocharger 2, the intermediate intake pipe 4, the intercooler 5, the surge tank 8 and the intake manifold constitute an intake passage of the engine.

An upstream end side of a catalytic converter 11 as an exhaust gas purifier is connected to an exhaust gas outlet side of the turbine 2*a* of the turbocharger 2. The catalytic converter 11 has a built-in catalyst which purifies the exhaust gas and is provided such that the center line extends in the cylinder lined-up direction along the exhaust-side surface of the engine body 1.

As illustrated in FIG. 1, a downstream end side of the catalytic converter 11 is connected to a particulate matter removing device (hereinafter, referred to as "filter device") 12 as the exhaust gas purifier. The filter device 12 has a filter built therein to remove particulate matter (such as soot) within the exhaust gas, and has a center line along the cylinder lined-up direction along the exhaust-side surface of the engine body 1. An upstream end side of the filter device 12 is disposed near the downstream end side of the catalytic converter 11 so that they are connected vertically.

A downstream end outlet of the filter device 12 is biased below a center line of the filter. Therefore, a lower surface side of the filter device 12 extends substantially horizontally from a filter accommodating part 12*a* to the outlet, while an upper surface side of the filter device 12 obliquely declines from the filter accommodating part 12*a* toward the outlet. A flexible exhaust pipe 14 is connected to the downstream end outlet of the filter device 12 via a curved pipe 13. The flexible exhaust pipe 14 is connected with an exhaust pipe (not illustrated) having a silencer and extending to a rear end of the automobile.

Here, the exhaust manifold, the turbine 2*a* of the turbocharger 2, the catalytic converter 11, the filter device 12, the curved pipe 13, the flexible exhaust pipe 14 and the exhaust pipe having the silencer constitute an exhaust passage of the engine.

<EGR Device>

The curved pipe 13 constituting the exhaust passage and the upstream-side intake pipe 3 constituting the intake passage are connected to each other by the EGR passage which recirculates a portion of the exhaust gas as the EGR gas, from the exhaust passage to the intake passage.

To explain about the EGR passage, an EGR cooler 15 which cools the EGR gas is coupled (directly attached) to an upper surface of the curved pipe 13 and vertically stands from the curved pipe 13. The EGR cooler 15 is configured by accommodating a heat exchanger for exchanging heat between the EGR gas and a coolant in a case, and a lower end (EGR gas inlet) of the case is coupled to the curved pipe 13. A flexible EGR pipe 16 is connected to an upper end (EGR gas outlet) of the case of the EGR cooler 15 and extends upward. An upper end of the EGR pipe 16 is connected to the upstream-side intake pipe 3 via an EGR valve 17. That is, the EGR valve 17 is directly attached to the upstream-side intake pipe 3, and the upstream end of the EGR pipe 16 is connected to the EGR valve 17. The EGR cooler 15, the EGR pipe 16 and the EGR valve 17 constitute the EGR passage.

A connected part of the upstream-side intake pipe 3 to which a downstream end of the EGR passage is connected is located higher than the connected part of the curved pipe 13 to which the upstream end of the EGR passage is connected. Further, the EGR passage extends upward throughout the entire length from the connected part for the curved pipe 13 to the connected part for the upstream exhaust pipe 3.

[Connecting Structure of EGR Cooler with Exhaust Passage]

Figure 3:
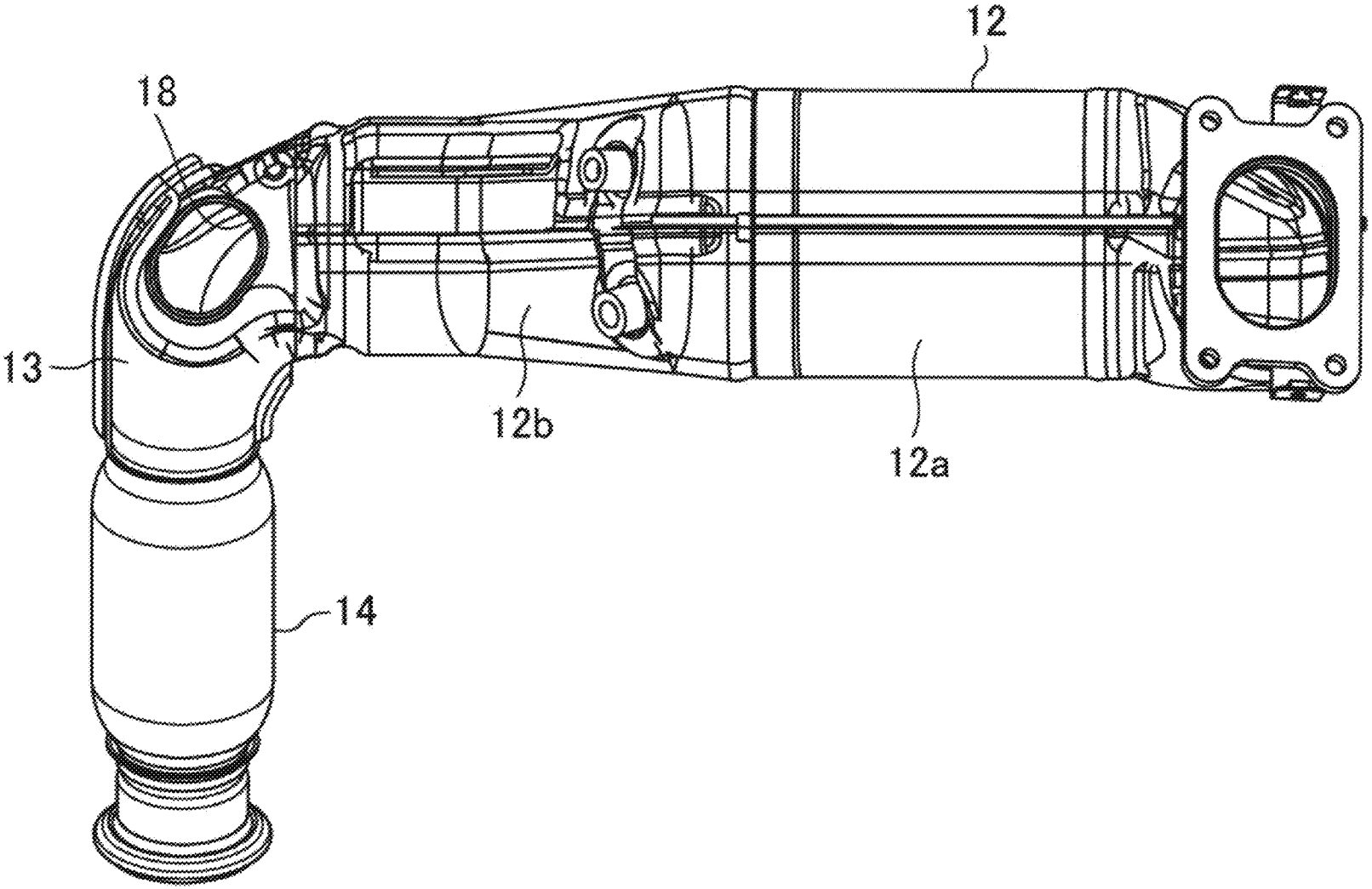
FIG. 3 is a plan view of a part of an exhaust pipe to which an EGR cooler of the engine is coupled.

As illustrated in FIG. 3, the curved pipe 13 constitutes a curve of the exhaust passage which changes a flow direction of the exhaust gas passed through the filter device 12, from the cylinder lined-up direction to a rear direction of the automobile.

Further, a through-hole 18 communicating an internal space of the case of the EGR cooler 15 with the exhaust passage opens to an upper surface of the curved pipe 13 (i.e., a passage wall upstream of the curve of the exhaust passage). The center of the opening of the through-hole 18 is on an outer circumferential side than a center in a width direction of the curved pipe 13. That is, the through-hole 18 opens to the passage wall of the curve of the exhaust passage at the outer circumferential side, and is a long hole elongated in the flow direction of the exhaust gas inside the curved pipe 13.

Figure 4:
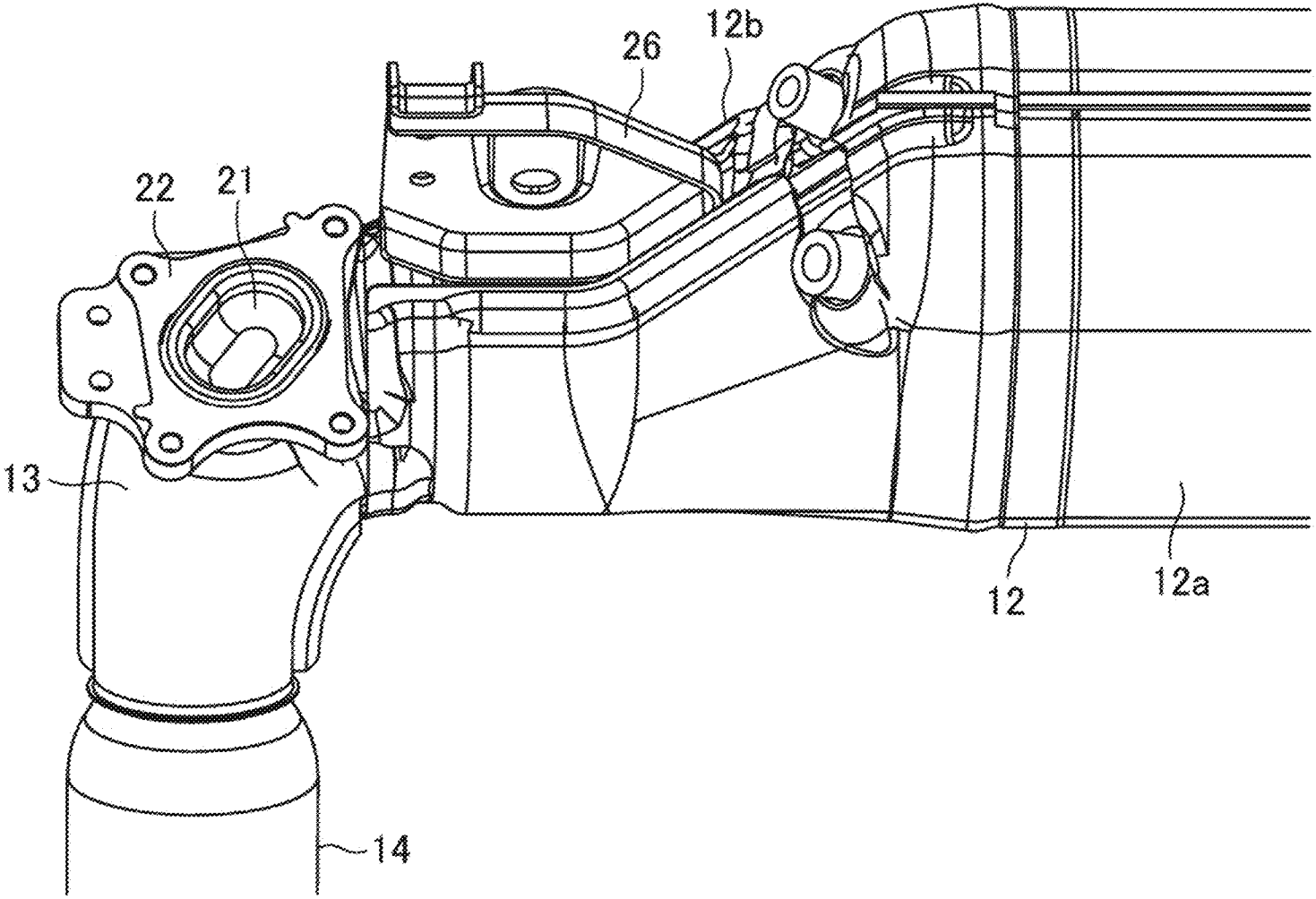
FIG. 4 is a perspective view illustrating a state where a flange member is fixed to a part of the exhaust pipe to which the EGR cooler is coupled.
Figure 5:
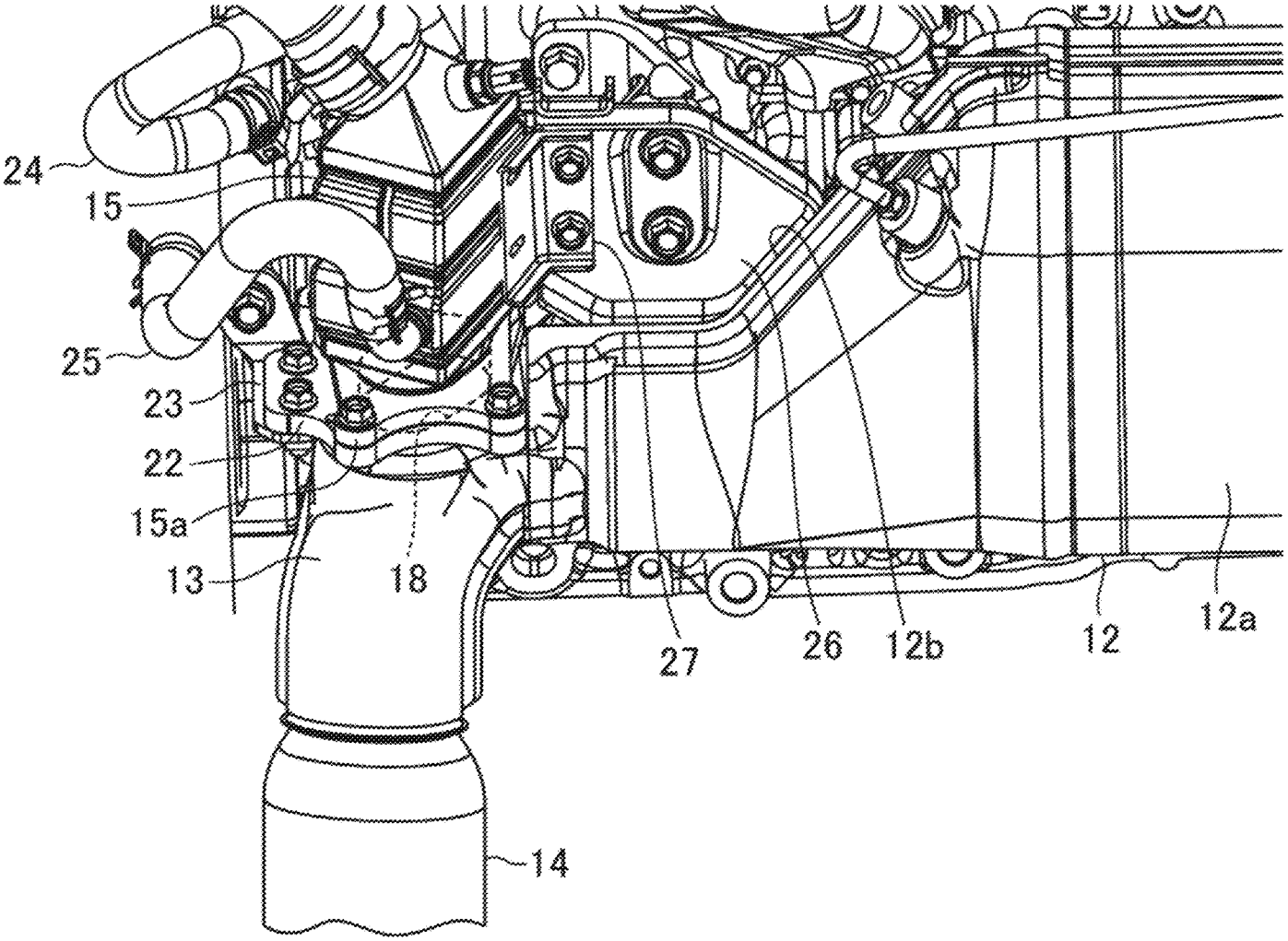
FIG. 5 is a perspective view illustrating a state where the EGR cooler is coupled to the exhaust pipe.

As illustrated in FIG. 4, a flange member 22 having a center hole into which a particulate matter filter 21 corresponding to the through-hole 18 is fitted is fixed to the upper surface of the curved pipe 13. As illustrated in FIG. 5, a flange 15*a* at the lower end (upstream end) side of the EGR cooler 15 is coupled to the flange member 22 in the upper surface of the curved pipe 13, and the EGR cooler 15 stands on the curved pipe 13. The flange member 22 is fixed to the upper surface of the curved pipe 13 and is supported by a bracket 23 fixed to the cylinder block 1*a*. As can be seen in FIG. 5, the EGR cooler 15 is oriented such that a center line thereof (substantially vertically through the through-hole 18) intersects with a flow direction of the exhaust gas flowing through the curved pipe 13 where the EGR cooler 15 is joined.

The hole opened to the flange 15*a* at the lower end side of the EGR cooler 15 and the hole in the flange member 22 are long holes similar to the through-hole 18 of the curved pipe 13 and form a through-hole communicating the internal space of the EGR cooler 15 with the exhaust passage. These long holes serve as EGR gas inlets of the EGR cooler 15. A supply pipe 24 for cooling water (i.e., coolant) and a return pipe 25 are connected to the EGR cooler 15.

Moreover, a support plate 26 is fixed to a part 12*b* downwardly inclined from the filter accommodating part 12*a* toward the downstream end side outlet of the filter device 12. The EGR cooler 15 is supported to the support plate 26 by a bracket 27. [EGR Pipe and Connecting Structure thereof for Intake Passage]

Figure 6:
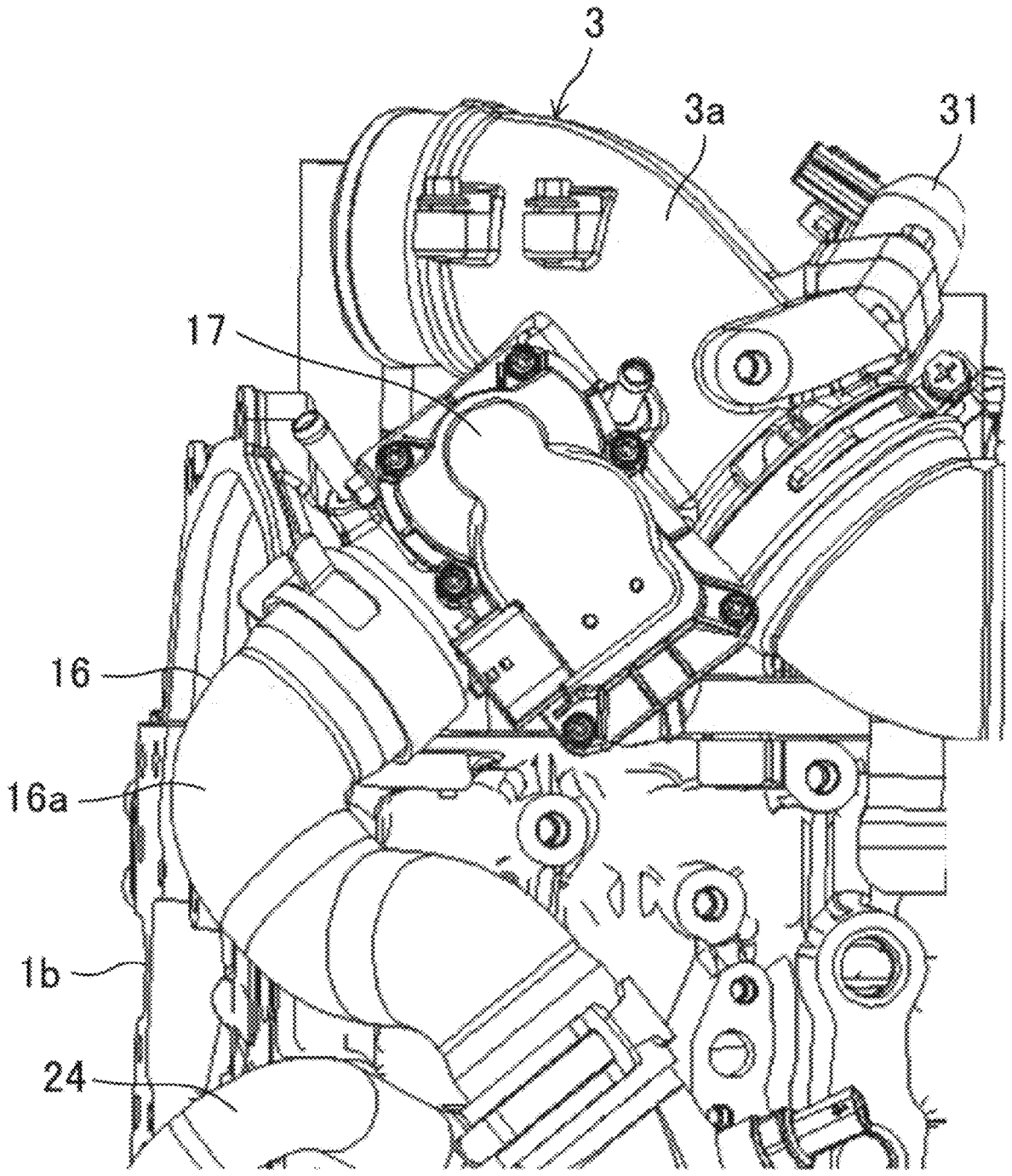
FIG. 6 is a side view of an upper part of the engine.

As illustrated in FIG. 6, the upstream-side intake pipe 3 constituting the intake passage has a declined part 3*a* obliquely inclining toward the compressor 2*b* of the turbocharger 2. Thus, the EGR pipe 16 constituting the EGR passage has a curve 16*a* in an intermediate part thereof and is connected to the obliquely declined part 3*a* of the upstream-side intake pipe 3 via the EGR valve 17. A blow-by gas introduction pipe 31 which introduces the blow-by gas of the engine into the intake passage is connected to the obliquely declined part 3*a* of the upstream-side intake pipe 3.

Figure 7:
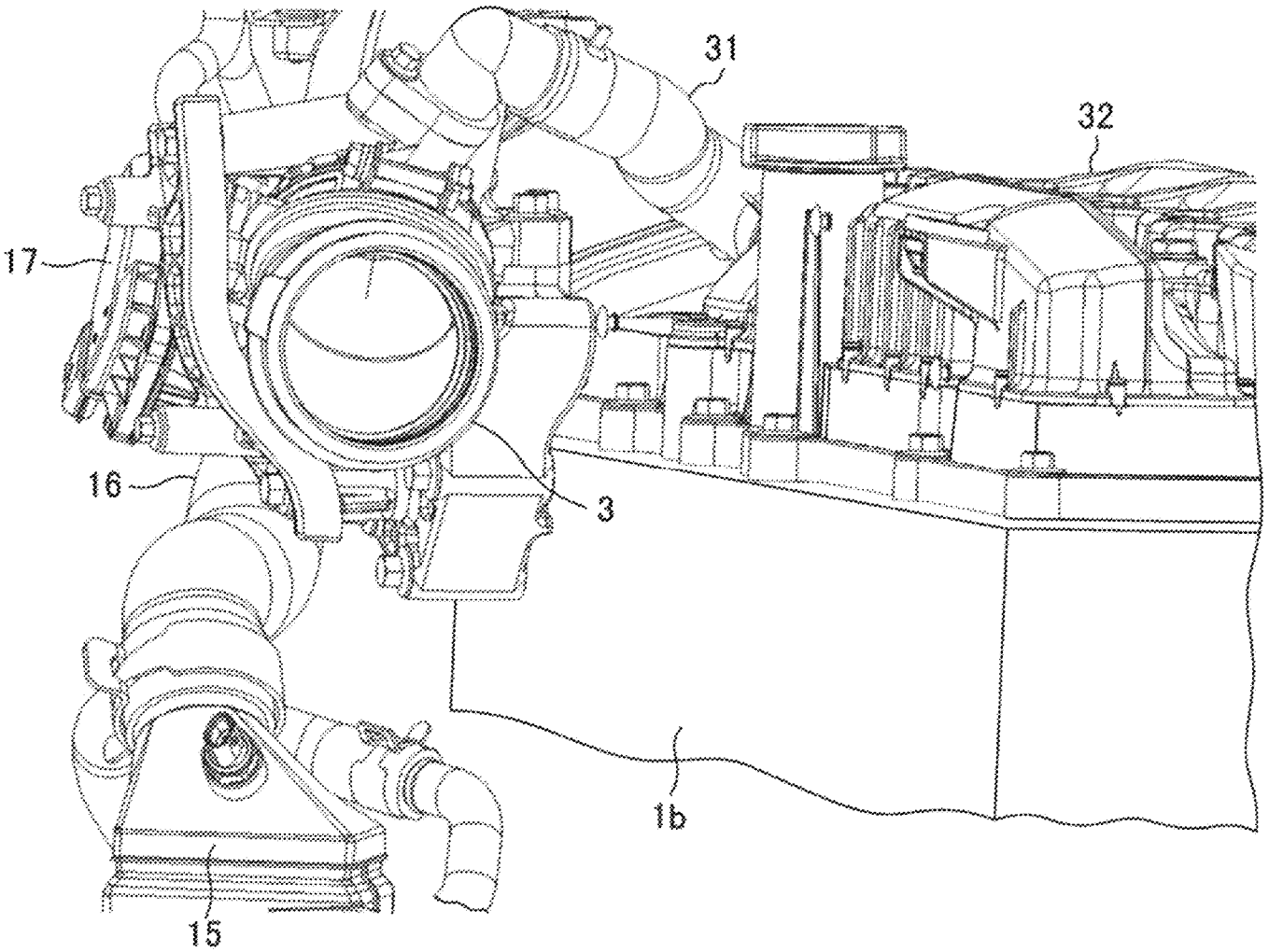
FIG. 7 is a perspective view illustrating a connecting structure for an intake pipe, an EGR pipe and a blow-by gas introduction pipe of the engine.

The blow-by gas introduction pipe 31 extends from an oil separator provided inside a cylinder head cover 32 of the engine illustrated in FIG. 7. The blow-by gas is separated from oil in the oil separator and introduced into the intake passage.

Figure 8:
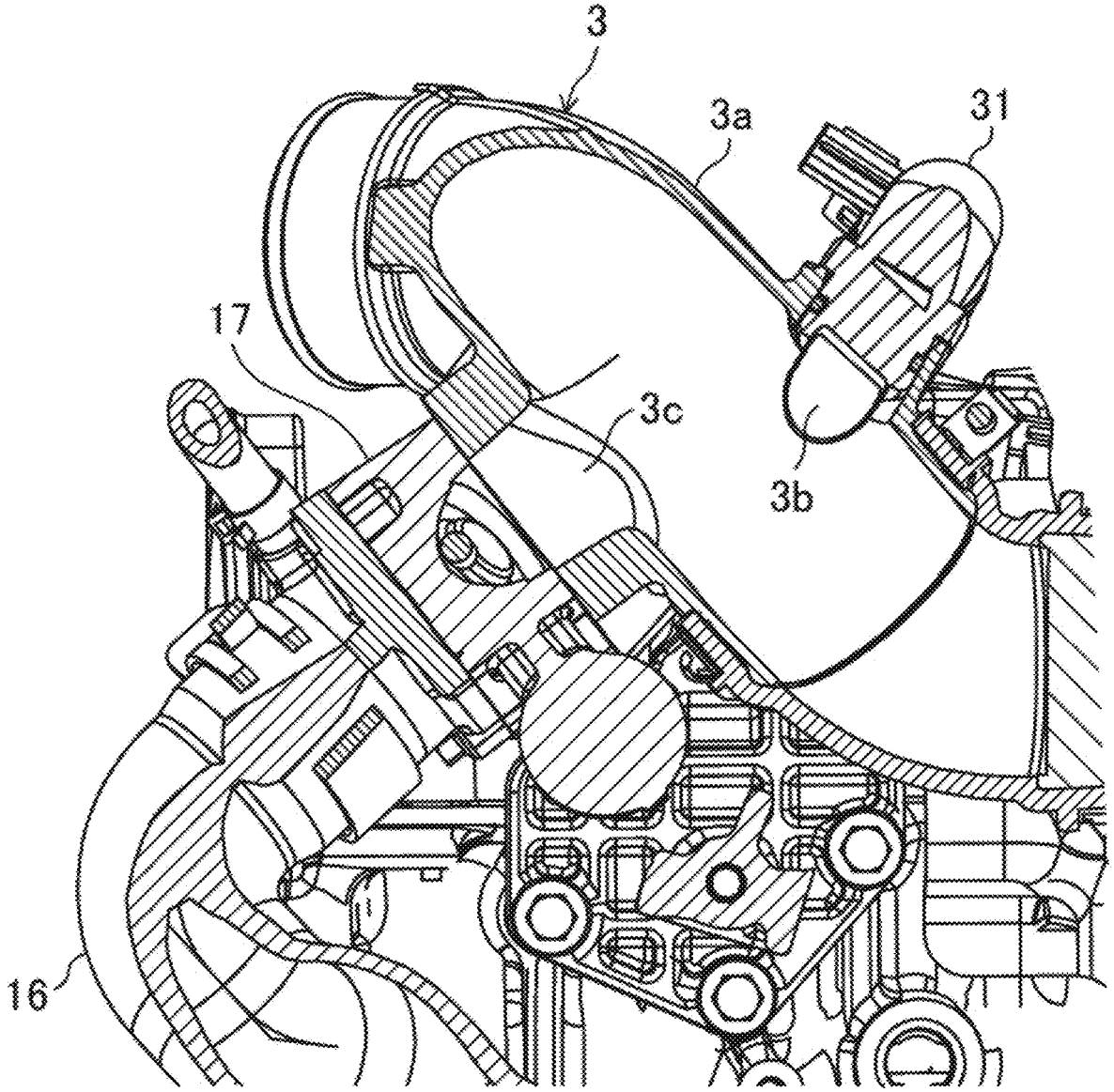
FIG. 8 is a cross-sectional view of the connecting structure.
Figure 9:
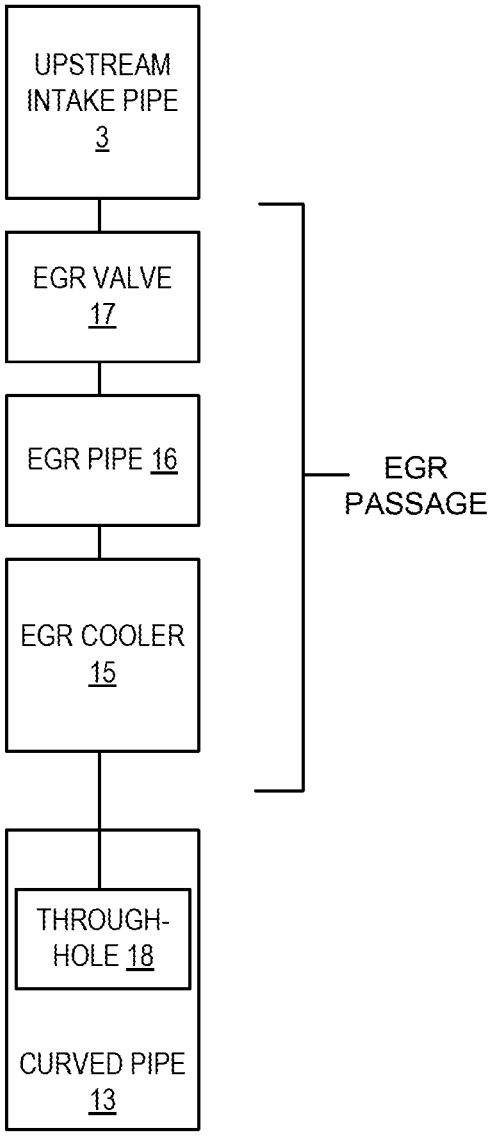

As illustrated in FIG. 8, in the obliquely declined part 3*a* of the upstream-side intake pipe 3, a blow-by gas introduction port 3*b* is positioned downstream of an EGR gas introduction port 3*c* in the flow direction of the intake air.

<Advantage of Intake and Exhaust System of Engine>

In the intake and exhaust system of the engine according to this embodiment, the exhaust gas of the engine is discharged from the exhaust manifold of the cylinder head 1*b* to the turbine 2*a* of the turbocharger 2, the catalytic converter 11, the filter device 12, the curved pipe 13 and the flexible exhaust pipe 14. When the EGR device is operated (the EGR valve 17 is opened), a portion of the exhaust gas is introduced into the upstream-side intake pipe 3 from the curved pipe 13 through the EGR cooler 15, the EGR pipe 16 and the EGR valve 17, and is supplied to a combustion chamber of the engine together with the intake air.

As illustrated in FIG. 3, the through-hole 18 communicating the internal space of the case of the EGR cooler 15 with the exhaust passage is formed into a long hole elongated in the flow direction of the exhaust gas in the curved pipe 13. Therefore, a portion of the exhaust gas, as the EGR gas, flows into the EGR cooler 15 at a relatively uniform flow rate, while spreading from the entire area of the long through-hole 18 in the flow direction of the exhaust gas, to flow through the heat exchanger. For this reason, compared to a simple circular through-hole having the same opening area, utilization efficiency of the EGR cooler 15 improves, which becomes advantageous for cooling the EGR gas. Further, since the filter 21 is provided in the through-hole 18, even if particulate matter, such as soot, within the exhaust gas flows thereto without being captured by the filter device 12 on the upstream side thereof, entrance of the soot, etc. into the EGR passage is blocked by the filter 21.

In the exhaust passage downstream of the filter device 12, pressure of the exhaust gas is lower than that on the upstream side. However, the coupled position of the EGR cooler 15, although is also on the downstream side, is in a portion close to the outer circumference of the upper surface of the curved pipe 13 constituting the curve of the exhaust passage. Since the flow of the exhaust gas is slower and the pressure of the exhaust gas is relatively higher on the outer circumferential side of the curve of the exhaust passage than on the inner circumferential side, the EGR gas is efficiently introduced into the EGR cooler 15.

Further, the EGR passage extends upward throughout the entire length from the curved pipe 13 constituting the exhaust passage to the upstream-side exhaust pipe 3 constituting the intake passage, without providing a part curving downward in the intermediate part. Therefore, the EGR gas easily flows from the exhaust passage toward the intake passage, which is advantageous in improving the utilization efficiency of the EGR cooler 15. Moreover, even when the EGR gas is condensed on the inner wall of the EGR passage to generate the condensed water, it is easily discharged to the exhaust passage.

When the EGR gas is cooled by passing through the EGR cooler 15, the condensed water is easily generated. By causing condensation on the wall surface of the curve 16*a* when the EGR gas passes through the curve 16*a* in the intermediate part of the EGR pipe 16, condensation on the EGR valve 17 is prevented. That is, the curve 16*a* of the EGR pipe 16 serves as a condensation facilitating portion to prevent freezing of the EGR valve 17 due to condensation water. Note that the condensation water generated in the curve 16*a* flows down to the exhaust passage and is discharged together with the exhaust gas.

Moreover, although the blow-by gas contains a large amount of moisture, as illustrated in FIG. 8, in the obliquely declined part 3*a* of the upstream-side intake pipe 3, the blow-by gas introduction port 3*b* is positioned downstream of the EGR gas introduction port 3*c* in the flow direction of the intake air. Therefore, it is difficult for the blow-by gas to flow toward the EGR passage. Even if the blow-by gas flows toward the EGR passage, since the EGR valve 17 is directly attached to the upstream-side intake pipe 3, the amount of condensed water accumulated on the EGR valve 17 is small. Thus, although the condensed water freezes, since this ice is thin, it is easily broken by driving the EGR valve 17 by a motor. As a result, malfunction of the EGR valve 17 by freezing is avoided.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Engine
2 Turbocharger
3 Upstream-side Intake Pipe
11 Catalyst Converter (Exhaust Gas Purifier)
12 Filter Device (Exhaust Gas Purifier)
13 Curved Pipe (Curve Portion of Exhaust Passage)
15 EGR Cooler
16 EGR Pipe
17 EGR Valve
18 Through-hole
22 Flange Member (Part on EGR Gas Inlet Side of EGR Cooler)

What is claimed is:

1. An intake and exhaust system of an engine, comprising:

an exhaust gas recirculation (EGR) passage configured to recirculate a portion of exhaust gas as EGR gas, from an exhaust passage of the engine to an intake passage; and an EGR cooler disposed in the EGR passage, the EGR cooler being coupled to a passage wall of the exhaust passage at an EGR gas inlet side, and having a center line intersecting with a flow direction of exhaust gas in the exhaust passage, wherein a through-hole communicating the EGR cooler with the exhaust passage is elongated in the flow direction in the exhaust passage.

2. The system of claim 1, wherein an exhaust gas purifier is provided in an intermediate part of the exhaust passage, wherein the exhaust gas passage has a curve on a downstream side of the exhaust gas purifier in the flow direction to change the flow direction, and wherein the through-hole communicating the EGR cooler with the exhaust passage opens to a passage wall of the curve of the exhaust passage at an outer circumferential side.

3. The system of claim 1, wherein a position of the intake passage to which the EGR passage is connected is located higher than a position of the exhaust passage to which the EGR passage is connected, and wherein the EGR cooler is coupled at the EGR gas inlet side to an upper surface side of the passage wall of the exhaust passage, and the entire EGR passage extends upwardly toward the position of the intake passage to which the EGR passage is connected.

4. The system of claim 2, wherein a position of the intake passage to which the EGR passage is connected is located higher than a position of the exhaust passage to which the EGR passage is connected, and wherein the EGR cooler is coupled at the EGR gas inlet side to an upper surface side of the passage wall of the exhaust passage, and the entire EGR passage extends upwardly toward the position of the intake passage to which the EGR passage is connected.

* * * * *